US009246267B2

(12) United States Patent
Katayanagi

(10) Patent No.: US 9,246,267 B2
(45) Date of Patent: Jan. 26, 2016

(54) CONNECTOR MATEABLE WITH A MATING CONNECTOR INCLUDING A MATING SHELL AND HAVING A MATED-STATE MAINTAINING STRUCTURE

(71) Applicant: Japan Aviation Electronics Industry, Limited, Tokyo (JP)

(72) Inventor: Masayuki Katayanagi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/553,030

(22) Filed: Nov. 25, 2014

(65) Prior Publication Data

US 2015/0229073 A1 Aug. 13, 2015

(30) Foreign Application Priority Data

Feb. 13, 2014 (JP) ..... 2014-025027

(51) Int. Cl.
*H01R 13/627* (2006.01)
*H01R 13/6583* (2011.01)
*H01R 12/72* (2011.01)

(52) U.S. Cl.
CPC ..... *H01R 13/6271* (2013.01); *H01R 13/6273* (2013.01); *H01R 13/6275* (2013.01); *H01R 13/6583* (2013.01); *H01R 12/724* (2013.01)

(58) Field of Classification Search
CPC ..... H01R 13/6273; H01R 13/6275
USPC ..... 439/349, 350, 352, 362, 607.53
See application file for complete search history.

(56) References Cited

U.S. PATENT DOCUMENTS

| | | | | |
|---|---|---|---|---|
| 3,711,816 | A * | 1/1973 | Schumacher | H01R 13/62933 439/352 |
| 6,123,575 | A * | 9/2000 | Huang | H01R 13/6273 439/352 |
| 6,869,301 | B2 * | 3/2005 | Shimizu | H01R 13/6276 439/324 |
| 7,384,295 | B2 | 6/2008 | Hankey et al. | |
| 2015/0214673 | A1 * | 7/2015 | Gao | H01R 13/6275 439/352 |

FOREIGN PATENT DOCUMENTS

| | | |
|---|---|---|
| CN | 202094354 U | 12/2011 |
| JP | 2008-527651 A | 7/2008 |
| JP | 3172188 U | 11/2011 |

OTHER PUBLICATIONS

Taiwanese Office Action in 103141560, dated Sep. 17, 2015, with English translation.

* cited by examiner

*Primary Examiner* — Tho D Ta
(74) *Attorney, Agent, or Firm* — Collard & Roe, P.C.

(57) ABSTRACT

A connector is mateable with a mating connector including a mating shell. The connector includes a maintaining member. The maintaining member has a first portion and a second portion. The first portion has a first arm and a first maintaining portion supported by the first arm. The second portion has a second arm and a second maintaining portion supported by the second arm. When the connector and the mating connector are mated with each other, a side portion of the mating shell is inserted between a front end of the first portion and a front end of the second portion. When the connector is in a mated state where the connector is mated with the mating connector, the maintaining member holds the side portion of the mating shell by the first maintaining portion and the second maintaining portion to maintain the mated state.

14 Claims, 7 Drawing Sheets

CONNECTOR MATEABLE WITH A MATING CONNECTOR INCLUDING A MATING SHELL AND HAVING A MATED-STATE MAINTAINING STRUCTURE

CROSS REFERENCE TO RELATED APPLICATIONS

An applicant claims priority under 35 U.S.C. §119 of Japanese Patent Application No. JP2014-025027 filed Feb. 13, 2014.

BACKGROUND OF THE INVENTION

This invention relates to a connector mateable with a mating connector including a mating shell.

In many cases, this type of connector has a mated-state maintaining structure for maintaining a mated state thereof with a mating connector. For example, JP-A 2008-527651 (Patent Document 1) discloses a connector having the mated-state maintaining structure which is constituted of a friction lock; the content of Patent Document 1 is incorporated herein by reference.

Referring to FIG. 13, Patent Document 1 discloses a Universal Serial Bus (USB)-socket (connector) 910 as an existing connector. The USB-socket 910 is mateable with a USB-plug (mating connector) 950 including a metal housing (mating shell) 960. The metal housing 960 has an upper surface 962. At least the upper surface 962 is formed with two openings 964. The USB-socket 910 includes a receptacle shell 920. The receptacle shell 920 has an upper surface, wherein at least the upper surface is formed with two leaf springs 922 which are resiliently deformable in an upper-lower direction (Z-direction). When the USB-plug 950 is mated with the USB-socket 910, the metal housing 960 is inserted into the receptacle shell 920. In the meantime, ends of the leaf springs 922 are moved upward to slide on the upper surface 962 of the metal housing 960. Under a mated state where the USB-plug 950 is mated with the USB-socket 910, the ends of the leaf springs 922 are engaged with the openings 964 of the metal housing 960, respectively, to maintain the mated state.

When the USB-plug 950 is mated with the USB-socket 910, the ends of the leaf springs 922 are moved upward to project beyond the upper surface of the receptacle shell 920. Accordingly, in a case where the USB-socket 910 is installed in a host device 900 to be used, the host device 900 is required to be provided with a space where the ends of the leaf springs 922 are moved. In other words, the host device 900 is required to become larger in the upper-lower direction by the size of the aforementioned space. As can be seen from the above explanation, the existing mated-state maintaining structure is not suitable to reduce the size of the host device 900 in the upper-lower direction.

SUMMARY OF THE INVENTION

It is therefore an object of the present invention to provide a connector which is to be installed in a device and which has a mated-state maintaining structure that enables the device to have a reduced size in an upper-lower direction.

One aspect of the present invention provides a connector mateable with a mating connector including a mating shell. The connector has a mating end which is to be mated with the mating connector. The mating end is located at a front end of the connector in a front-rear direction. The connector comprises two or more contacts, a holding member, a shell and a maintaining member. The holding member arranges the contacts in a pitch direction perpendicular to the front-rear direction to hold the contacts. The shell has an upper surface and a lower surface in an upper-lower direction perpendicular to both the front-rear direction and the pitch direction. One of the upper surface and the lower surface is a plane that has no part projecting outward in the upper-lower direction and has no part projectable outward in the upper-lower direction. The maintaining member has a first portion and a second portion. The first portion has a first arm and a first maintaining portion which is supported by the first arm. The second portion has a second arm and a second maintaining portion which is supported by the second arm. A front end of the first portion and a front end of the second portion are located apart from each other in the pitch direction. When the connector and the mating connector are mated with each other, a side portion of the mating shell is inserted between the front end of the first portion and the front end of the second portion, wherein the side portion of the mating shell intersects with the pitch direction. When the connector is in a mated state where the connector is mated with the mating connector, the maintaining member holds the side portion of the mating shell by the first maintaining portion and the second maintaining portion to maintain the mated state.

The maintaining member according to the present invention holds the side portion of the mating shell by the first maintaining portion and the second maintaining portion to maintain the mated state. Accordingly, each of the upper surface and the lower surface of the shell is not required to have a portion to maintain the mated state. For example, even when the upper surface of the shell is provided with a ground spring which is to be connected to the mating shell, the lower surface of the shell can be formed planarly. In other words, at least one of the upper surface and the lower surface of the shell is the plane that has no part projecting outward in the upper-lower direction and has no part projectable outward in the upper-lower direction. Accordingly, when the connector is installed in a device, the device is not required to have a space for mating on or under the connector. According to the present invention, a size of the device in the upper-lower direction can be reduced An appreciation of the objectives of the present invention and a more complete understanding of its structure may be had by studying the following description of the preferred embodiment and by referring to the accompanying drawings.

Figure 1:
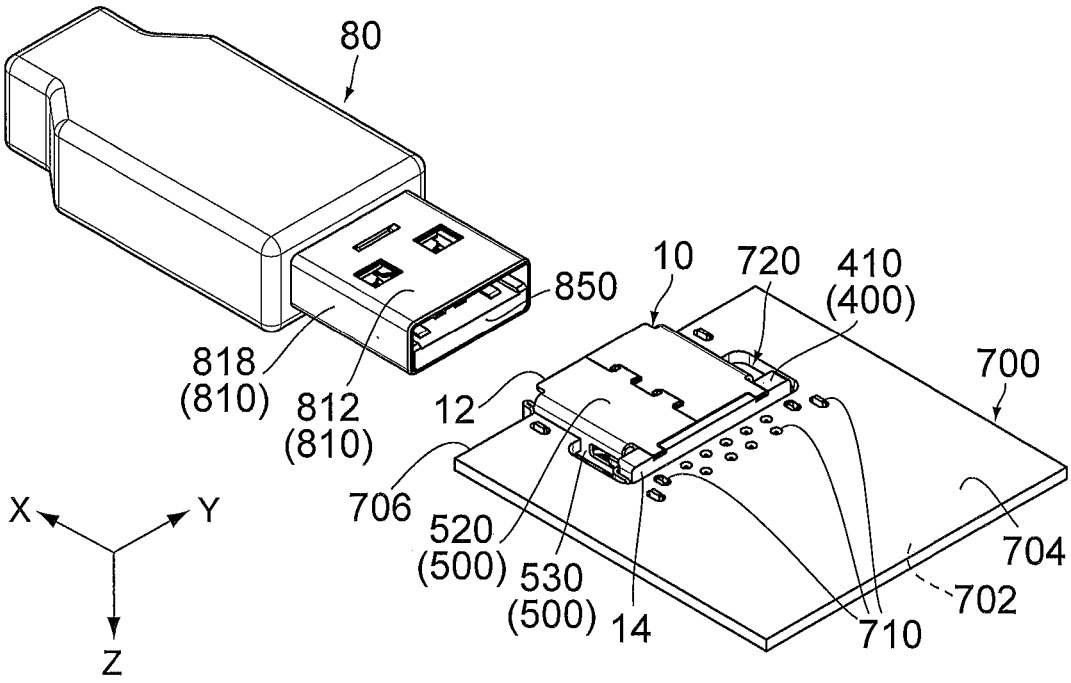
FIG. 1 is a lower perspective view showing a connector and a mating connector according to an embodiment of the present invention, wherein the connector is attached to a circuit board but not yet mated with the mating connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is a board connector that is attached to a circuit board 700 within a device (not shown) when used.

Figure 11:
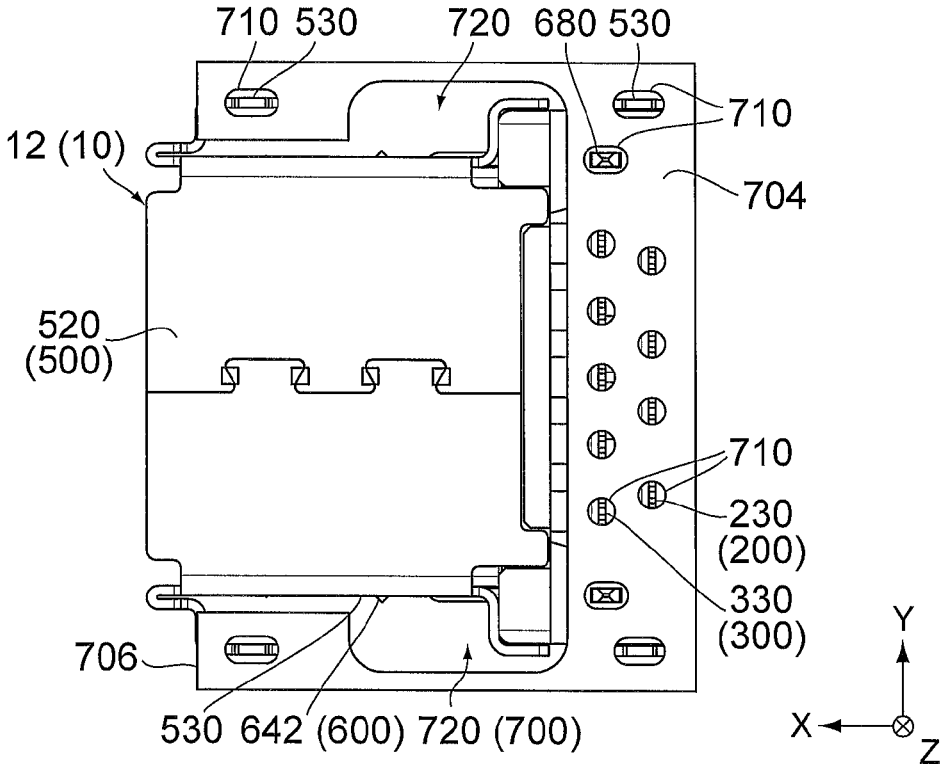
FIG. 11 is a bottom view showing the connector of FIG. 1 and a part of the circuit board of FIG. 1.

As shown in FIGS. 1 and 11, the circuit board 700 has an upper surface 702 and a lower surface 704 in an upper-lower direction (Z-direction). The circuit board 700 is formed with a plurality of fixing portions 710 and a receive portion 720. Each of the fixing portions 710 according to the present embodiment is a hole piercing the circuit board 700 in the Z-direction. The receive portion 720 is a cut which extends rearward (in the negative X-direction) from a front end 706 of the circuit board 700 in a front-rear direction (X-direction).

The connector 10 is inserted into the receive portion 720 from above the circuit board 700, or from the positive Z-side of the circuit board 700, to be fixed to the fixing portions 710. As can be seen from this structure, the connector 10 according to the present embodiment is a so-called drop-in connector and is also a through-hole connector. However, the present invention is not limited thereto. For example, the present invention is applicable to a connector which is mounted on the upper surface 702 of the circuit board 700 and a surface mount technology (SMT) connector.

Figure 2:
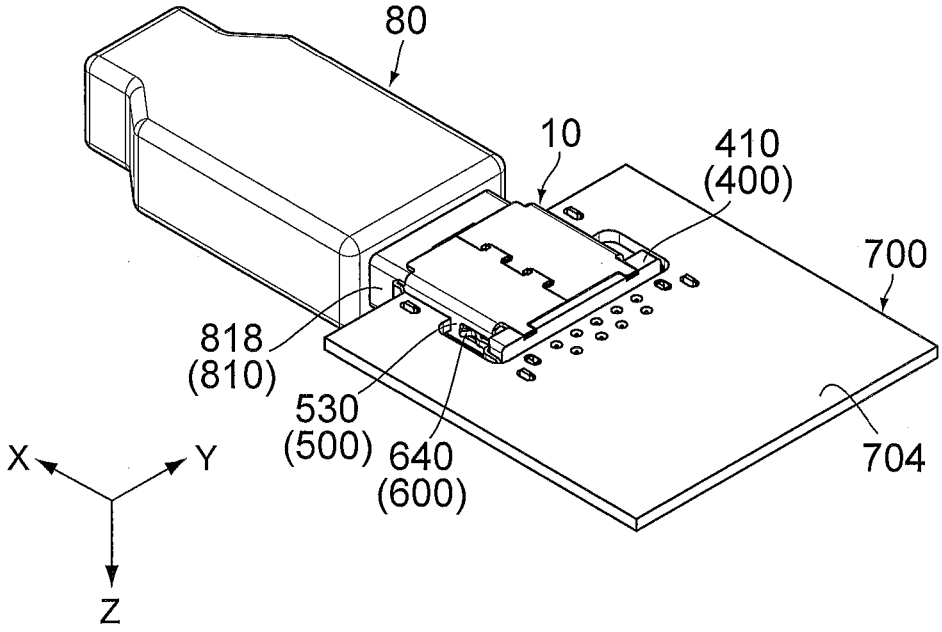
FIG. 2 is a lower perspective view showing the connector and the mating connector of FIG. 1, wherein the connector is attached to the circuit board and mated with the mating connector.

As shown in FIGS. 1 and 2, the connector 10 is mateable with a mating connector 80 along the X-direction. In the present embodiment, the connector 10 is a USB-receptacle in compliant with a Universal Serial Bus (USB) standard, and the mating connector 80 is a standard USB-plug in compliant with the USB standard. In other words, the connector 10 according to the present embodiment is mateable with a standard USB-plug which is one type of the mating connector 80. However, the present invention is also applicable to a connector other than a USB-receptacle. Moreover, the mating connector 80 does not need to be a USB-plug such as the standard USB-plug.

Figure 8:
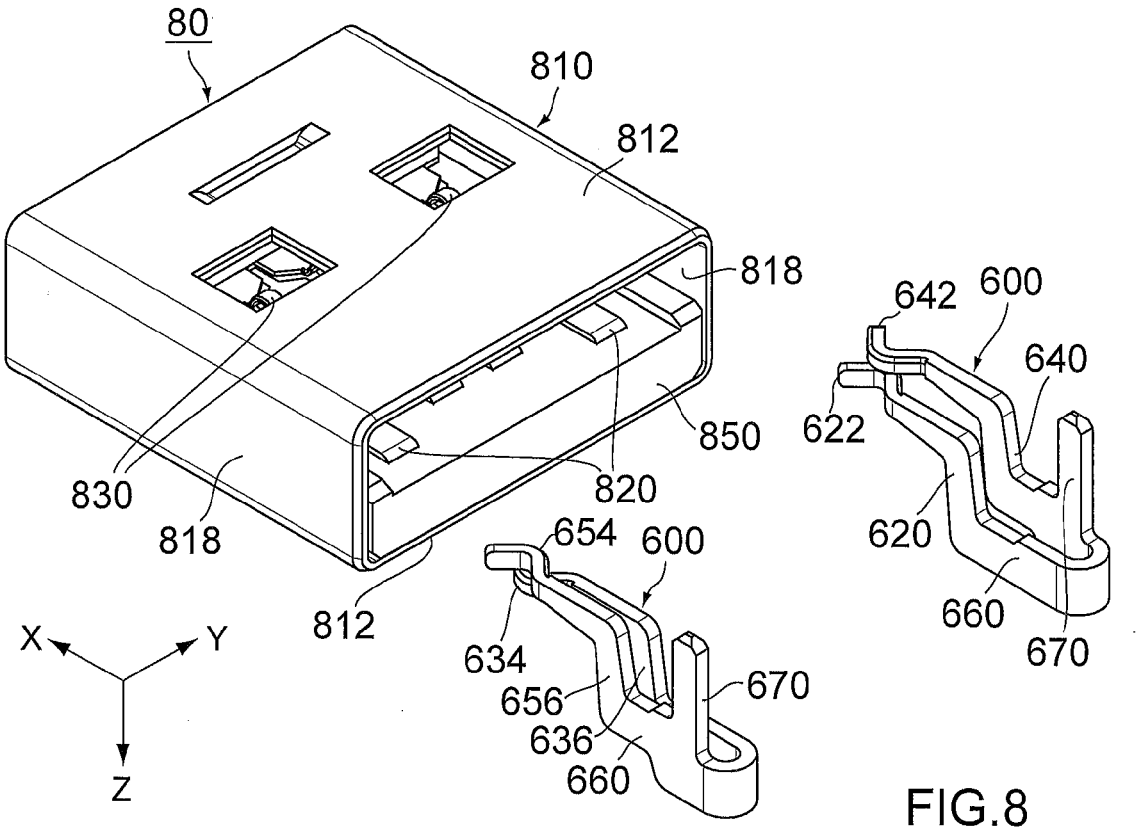
FIG. 8 is a lower perspective view showing the maintaining members of the connector of FIG. 3 and a part of the mating connector.

Referring to FIGS. 1 and 8, in the present embodiment, the mating connector 80 comprises a mating shell 810 made of metal, four first mating contacts 820 each made of conductor, five second mating contacts 830 each made of conductor and a mating holding member 850 made of insulator. The first mating contacts 820 are contacts for USB 2.0 connection, and the second mating contacts 830 are contacts for USB 3.0 connection. The first mating contacts 820 are arranged in a pitch direction (Y-direction) and held by the mating holding member 850. Similarly, the second mating contacts 830 are arranged in the Y-direction and held by the mating holding member 850.

The mating shell 810 covers the mating holding member 850. In detail, the mating shell 810 has two wide portions 812 and two side portions 818. Each of the wide portions 812 is formed with two openings while any one of the side portions 818 has no opening. In the present embodiment, each of the wide portions 812 is perpendicular to the Z-direction, and each of the side portions 818 is perpendicular to the Y-direction. However, it is sufficient that the wide portion 812 intersects with the Z-direction, and the side portion 818 intersects with the Y-direction.

Figure 3:
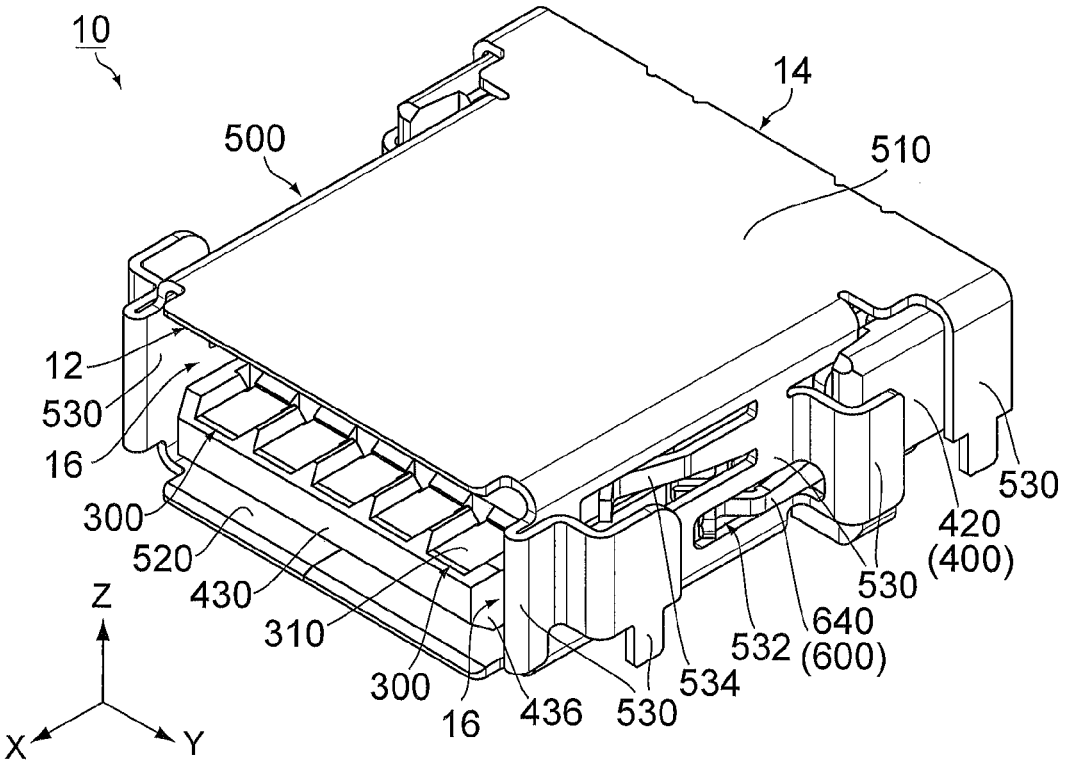
FIG. 3 is an upper perspective view showing the connector of FIG. 1.

As shown in FIGS. 1 and 3, the connector 10 has a mating end 12 which is to be mated with the mating connector 80. The mating end 12 is located at a front end (the positive X-side end) of the connector 10 in the X-direction. Moreover, the connector 10 has a furthest end 14 located at a rear end (the negative X-side end) that is furthest from the mating end 12 in a mating direction (front-rear direction, X-direction). When the mating connector 80 is mated with the connector 10, the mating connector 80 is inserted into the connector 10 from the front end (mating end) 12 toward the rear end (furthest end) 14.

Figure 4:
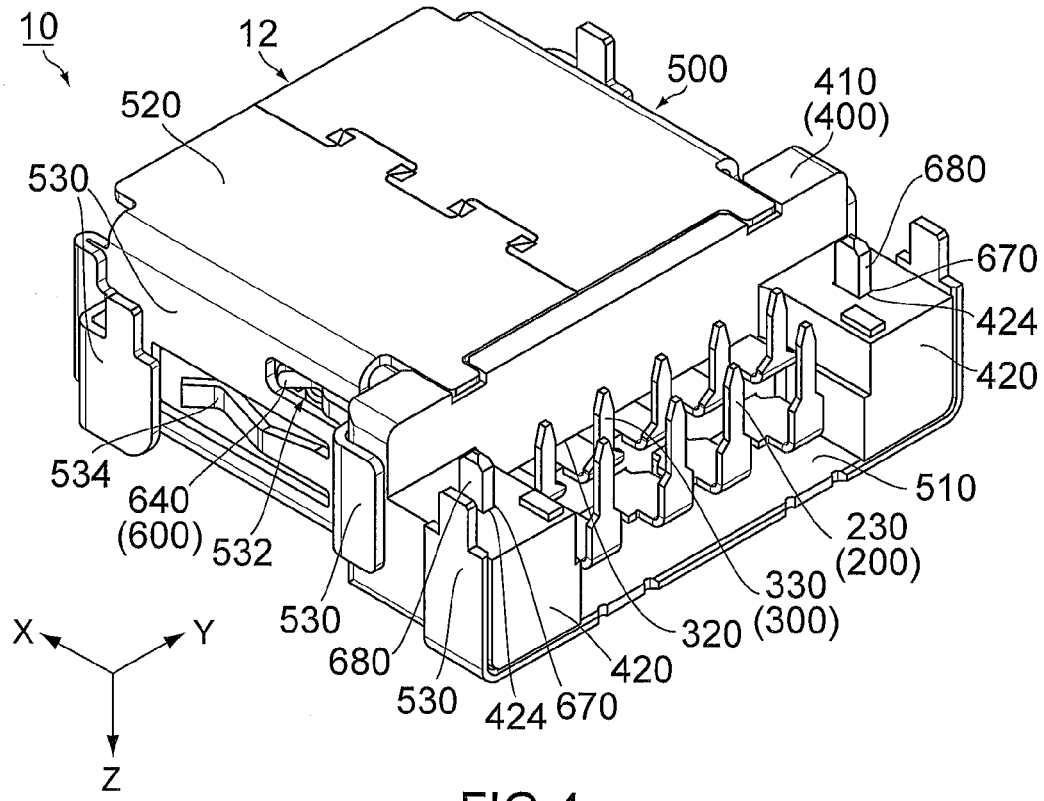
FIG. 4 is a lower perspective view showing the connector of FIG. 3.

As shown in FIGS. 3 and 4, the connector 10 according to the present embodiment comprises four (i.e. two or more) first contacts (contacts) 200 each made of conductor, five (i.e. two or more) second contacts (contacts) 300 each made of conductor, a holding member 400 made of insulator, a shell 500 made of metal and two maintaining members 600 each made of resiliently deformable material such as metal. The first contacts 200 are contacts for USB 2.0 connection, and the second contacts 300 are contacts for USB 3.0 connection.

Figure 6:
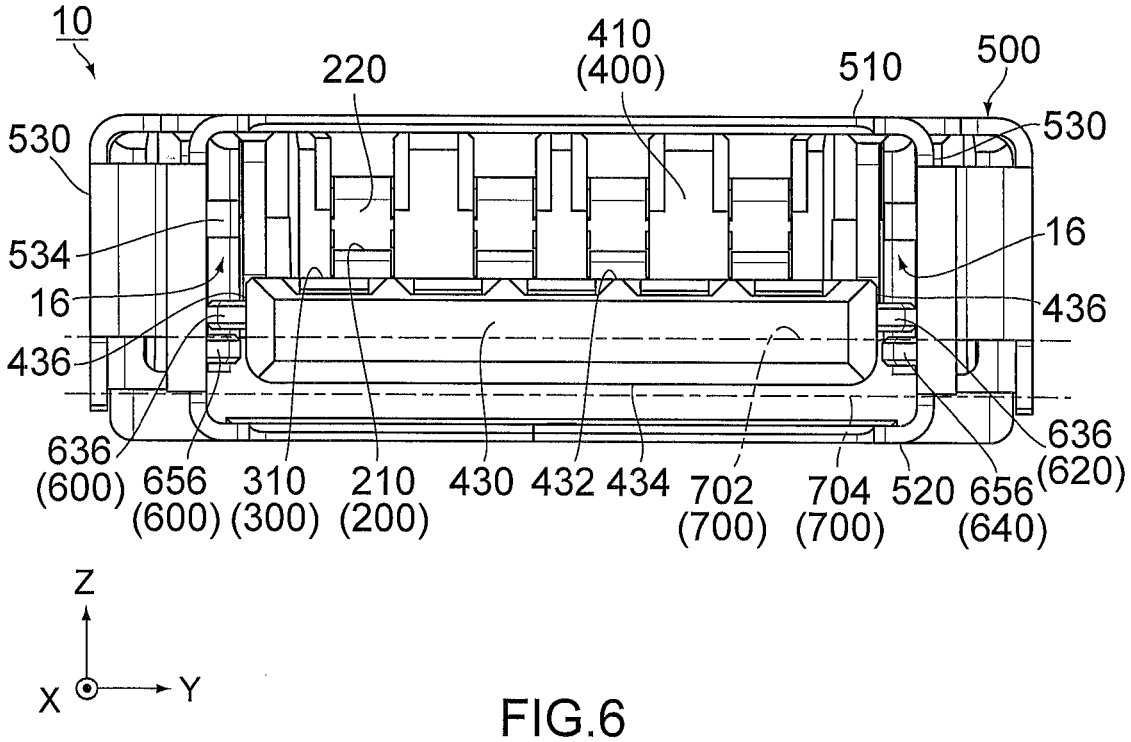
FIG. 6 is a front view showing the connector of FIG. 3, wherein the connector is attached the circuit board whose outline is illustrated by chain dotted line to show the positional relation between the connector and the circuit board.

As shown in FIGS. 4 and 6, the holding member 400 according to the present embodiment has a base portion 410, two side portions 420 and a plate-like portion 430. The base portion 410 has a flat plate-like shape perpendicular to the X-direction. However, the base portion 410 may be oblique to the X-direction to some extent. In other words, it is sufficient that the base portion 410 intersects with the X-direction. The side portions 420 protrude rearward from opposite sides of the base portion 410 in the Y-direction, respectively. The plate-like portion 430 extends forward (in the positive X-direction) from the base portion 410. In detail, the plate-like portion 430 extends along the X-direction and the Y-direction to have an upper surface 432 and a lower surface 434 in the Z-direction and two side surfaces 436 in the Y-direction. In other words, the plate-like portion 430 has a flat plate-like shape intersecting with the Z-direction. In particular, the plate-like portion 430 according to the present embodiment is perpendicular to the Z-direction.

Figure 9:
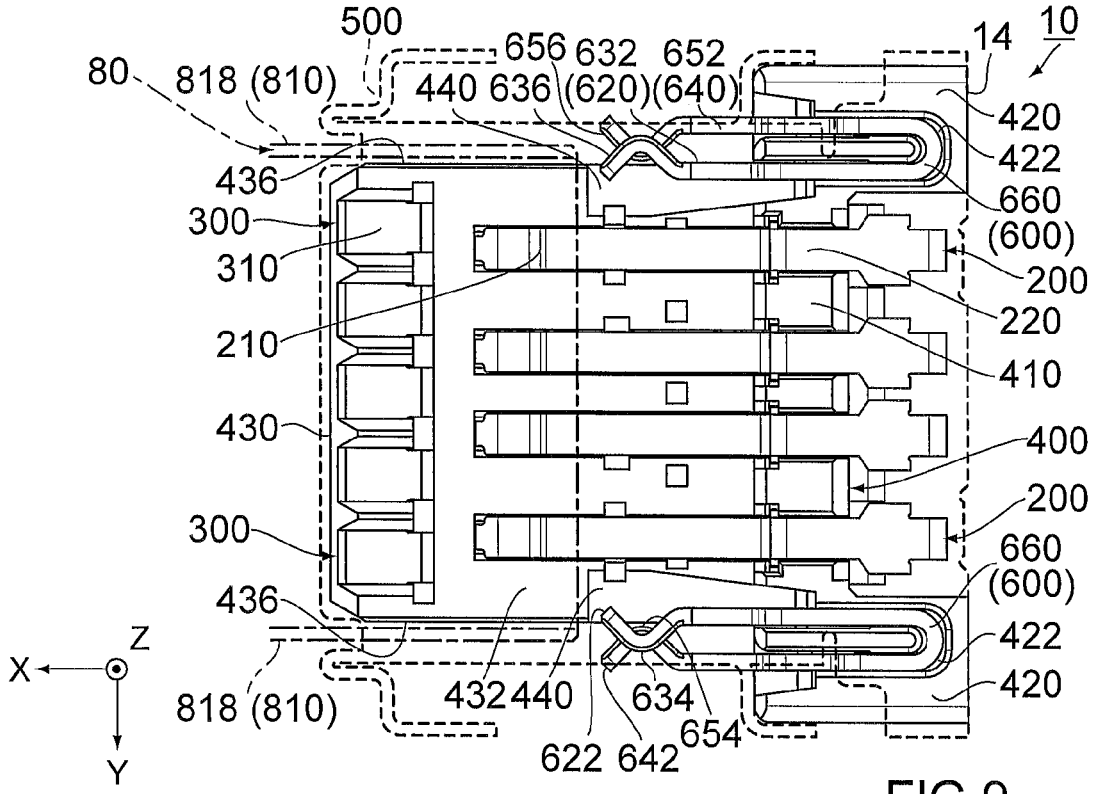
FIG. 9 is a top view showing the connector of FIG. 3, wherein an outline of a shell of the connector is illustrated by dashed line, and an outline of a mating shell of the mating connector under mating process is illustrated by chain dotted line.

As shown in FIGS. 4, 6 and 9, the holding member 400 arranges the first contacts 200 in the Y-direction to hold the first contacts 200. The first contacts 200 extend along the X-direction. Each of the first contacts 200 has a contact portion 210, a held portion 220 and a fixed portion 230. The contact portions 210 are arranged in the Y-direction on the upper surface 432 of the plate-like portion 430 (see FIG. 9). The held portions 220 are press-fit into the base portion 410 from above to be held by the base portion 410 (see FIG. 6). The fixed portions 230 extend downward (in the negative Z-direction) from the held portions 220, respectively (see FIG. 4).

As shown in FIGS. 3, 4 and 9, the holding member 400 arranges the second contacts 300 in the Y-direction to hold the second contacts 300. The second contacts 300 extend along the X-direction. Each of the second contacts 300 has a contact portion 310, a held portion 320 and a fixed portion 330. The contact portions 310 are arranged in the Y-direction on the upper surface 432 of the plate-like portion 430 (see FIG. 3). The held portions 320 are inserted into the base portion 410 and the plate-like portion 430 from behind to be held by the base portion 410 and the plate-like portion 430 (see FIG. 4). The fixed portions 330 extend downward (in the negative Z-direction) from the held portions 320, respectively (see FIG. 4).

Referring to FIG. 11, under an attached state where the connector 10 is attached to the circuit board 700, the fixed portions 230 and the fixed portions 330 are inserted in the fixing portions 710 of the circuit board 700, respectively, to be fixed by soldering or the like. Moreover, under the attached state, the fixed portions 230 and the fixed portions 330 are connected to conductive patterns (not shown) of the circuit board 700, respectively.

As can be seen from FIGS. 8 and 9, under a mated state where the connector 10 is completely mated with the mating connector 80 (see FIG. 2), the contact portions 210 are brought into contact with the first mating contacts 820, respectively, while the contact portions 310 are brought into contact with the second mating contacts 830, respectively.

Referring to FIGS. 4 and 9, each of the side portions 420 of the holding member 400 is formed with a holding ditch 422 and a holding hole 424. The holding ditch 422 is a ditch having U-like shape in the XY-plane. The holding hole 424 is a hole piercing the side portion 420 in the Z-direction. The holding hole 424 according to the present embodiment extends downward from the holding ditch 422.

As can be seen from FIG. 9, the plate-like portion 430 of the holding member 400 is formed with two recesses 440. The recesses 440 are located at opposite sides of the plate-like portion 430 in the Y-direction, respectively. The recesses 440 are located in front of the holding ditches 422, respectively. The recesses 440 are recessed downward from the upper surface 432 of the plate-like portion 430 while being recessed inward in the Y-direction from the two side surfaces 436 of the plate-like portion 430, respectively. Each of the recesses 440 increases in size in the Y-direction as a distance from the holding ditch 422 increases. Each of the recesses 440 has a bottom surface 442 (see FIG. 5). The bottom surface 442 is located below the upper surface 432 of the plate-like portion 430.

As can be seen from FIGS. 3 and 4, the shell 500 according to the present embodiment is formed of a single metal plate. The shell 500 covers the most part of the holding member 400. The shell 500 has an upper surface 510 and a lower surface 520 in the Z-direction and two side portions 530 in the Y-direction. The upper surface 510 of the shell 500 is a uniform plane that has no projection and no opening. Similarly, the lower surface 520 of the shell 500 is a uniform plane except a joint of the metal plate. In other words, in the present embodiment, each of the upper surface 510 and the lower surface 520 is a plane that has no part projecting outward in the Z-direction and has no part projectable outward in the Z-direction.

As shown in FIGS. 3 and 4, each of the side portions 530 of the shell 500 is variously bent and partially extends downward. Referring to FIG. 11, under the attached state, end portions of these downward extending portions are inserted in the fixing portions 710 of the circuit board 700, respectively, to be fixed by soldering or the like. In other words, the shell 500 is grounded to the circuit board 700.

Figure 5:
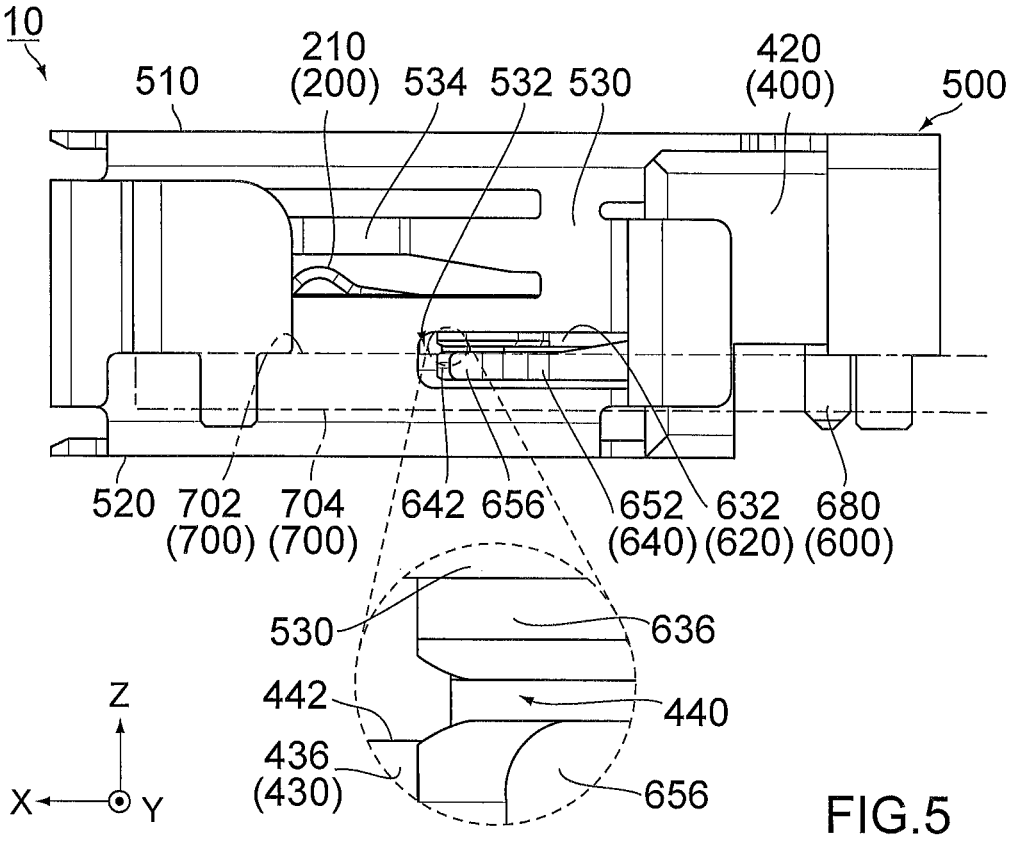
FIG. 5 is a side view showing the connector of FIG. 3, wherein the connector is attached the circuit board whose outline is illustrated by chain dotted line to show positional relation between the connector and the circuit board, and the vicinity of a front end of a maintaining member of the connector (the part encircled by dashed line) is enlarged to be illustrated.

As shown in FIGS. 3 to 5, each of the side portions 530 of the shell 500 is formed with an opening 532 and a contact piece 534. The opening 532 is provided at a position which corresponds to that of the recess 440 of the plate-like portion 430. The opening 532 pierces the side portion 530 in the Y-direction. The contact piece 534 protrudes into the connector 10 to be resiliently deformable in the Y-direction. The contact piece 534 is brought into contact with the side portion 818 of the mating shell 810 under the mated state (see FIG. 2).

Figure 7:
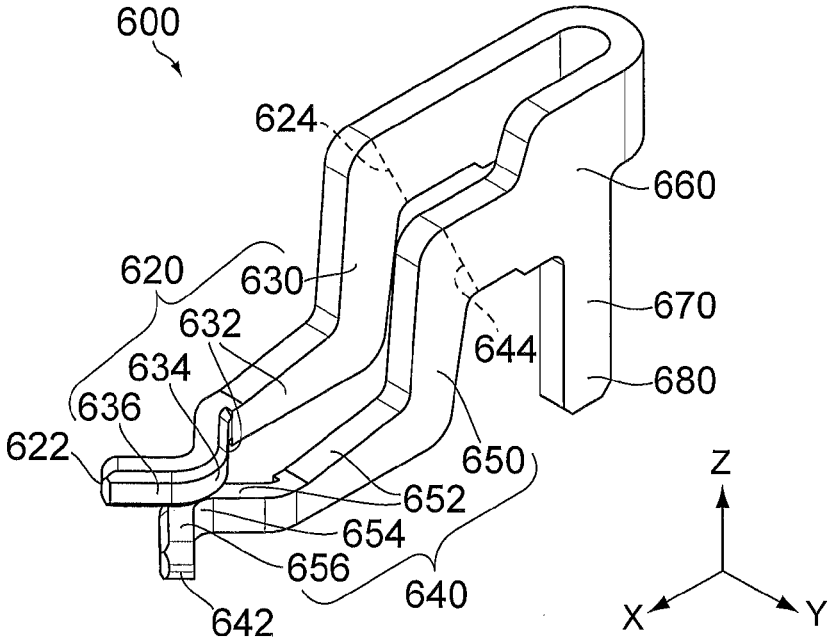
FIG. 7 is an upper perspective view showing the maintaining member of the connector of FIG. 3, wherein illustrated dashed line is imaginary line which shows position of rear end of each of a first portion and a second portion of the maintaining member.

Referring to FIGS. 7 and 8, each of the maintaining members 600 according to the present embodiment is formed by punching out and bending a single metal plate. In detail, each of the maintaining members 600 is formed by punching out the single metal plate to form a blank, followed by bending the blank. Each of the maintaining members 600 has a first portion (inside portion) 620, a second portion (outside portion) 640, a coupling portion 660, a held portion 670 and a fixed portion 680. The coupling portion 660 has a U-like shape in the XY-plane. The first portion 620 and the second portion 640 extend forward from opposite ends of the U-like shape, respectively. In other words, the coupling portion 660 couples the first portion 620 and the second portion 640 with each other. The held portion 670 extends downward from the coupling portion 660. The fixed portion 680 further extends downward from the held portion 670.

As shown in FIGS. 4 and 9, each of the maintaining members 600 according to the present embodiment is attached to and held by the holding member 400. In detail, the coupling portion 660 of the maintaining member 600 is inserted into the holding ditch 422 of the side portion 420 of the holding member 400 from above and held by the holding ditch 422. Moreover, the held portion 670 is inserted in and held by the holding hole 424. The fixed portion 680 projects downward from the side portion 420. After the maintaining members 600 are attached to the holding member 400, the shell 500 is attached to the holding member 400 from front to cover the maintaining members 600 from above.

As shown in FIGS. 8 and 9, the maintaining member 600 held by the positive Y-side side portion 420 and the maintaining member 600 held by the negative Y-side side portion 420 have shapes mirror-symmetrical to each other with respect to the XZ-plane. Except for this point, the two maintaining members 600 have structures same as each other and function same as each other.

As shown in FIG. 7, the first portion 620 extends from its rear end 624 to its front end 622 in the X-direction. The first portion 620 has a first slope 630, a first arm 632, a first maintaining portion 634 and a first guide 636. The first slope 630 extends forward from the rear end 624 while sloping downward. The first arm 632 extends forward from a front end of the first slope 630. The first arm 632 is narrower than the first slope 630 to be easily resiliently deformable. The first maintaining portion 634 is located in the vicinity of a front end of the first arm 632 and is supported by the first arm 632. The first guide 636 is located forward of the first maintaining portion 634.

The second portion 640 has a structure same as that of the first portion 620 except that the second portion 640 is located below the first portion 620 as a whole. In detail, the second portion 640 extends from its rear end 644 to its front end 642 in the X-direction. The second portion 640 has a second slope 650, a second arm 652, a second maintaining portion 654 and a second guide 656. The second slope 650 extends forward from the rear end 644 while sloping downward. The second arm 652 extends forward from a front end of the second slope 650. The second arm 652 is narrower than the second slope 650 to be easily resiliently deformable. The second maintaining portion 654 is located in the vicinity of a front end of the second arm 652 and is supported by the second arm 652. The second guide 656 is located forward of the second maintaining portion 654.

As shown in FIG. 9, the first portion 620 extends forward from the holding ditch 422 of the side portion 420. The first portion 620 partially passes through the inside of the recess 440 of the plate-like portion 430. A part of the first portion 620, more specifically, a part of the first arm 632 and a part of the first guide 636, are located at a position same as that of the recess 440 in the Z-direction (see FIG. 5) and located at the outside of the recess 440 in the Y-direction. The first arm 632 is resiliently deformable toward the recess 440. Accordingly, the first maintaining portion 634 and the first guide 636 are movable inward in the Y-direction.

Referring to FIGS. 5 and 9, the second portion 640 is located outward of the plate-like portion 430 in the Y-direction. The second arm 652, the second maintaining portion 654 and the second guide 656 of the second portion 640 are located at a position same as that of the opening 532 of the shell 500 in the XZ-plane. Moreover, under the attached state, the receive portion 720, or a space, is provided between the side portion 530 of the shell 500 and the circuit board 700 (see FIG. 11). Accordingly, even under the attached state, the second arm 652 is resiliently deformable so as to pass through the opening 532. In other words, the second maintaining portion 654 and the second guide 656 are movable outward in the Y-direction under the attached state.

Hereafter, explanation is made about a mated-state maintaining structure that is mainly formed of the maintaining members 600.

As shown in FIGS. 3 and 6, the connector 10 is formed with two insertion paths 16. Each of the insertion paths 16 is a space located between the side portion 530 of the shell 500 and the side surface 436 of the plate-like portion 430. When the mating connector 80 is mated with the connector 10 (see FIG. 2), the side portions 818 of the mating shell 810 are inserted into the insertion paths 16 along the negative X-direction, respectively.

As can be seen from FIGS. 6 and 9, under an unmated state where the mating connector 80 is not inserted in the connector 10 or is during mating process (the state shown in FIG. 6 or 9), the front end 622 of the first portion 620 and the front end 642 of the second portion 640 are located apart from each other in the Y-direction. In addition, according to the present embodiment, under the unmated state, the front end 622 of the first portion 620 is located within the recess 440 of the plate-like portion 430. Moreover, under the unmated state, the front end 642 of the second portion 640 is received in the opening 532 of the shell 500 to partially project to the outside of the shell 500.

Accordingly, as the side portion 818 of the mating shell 810 is inserted along the negative X-direction, the side portion 818 is brought into abutment with the first guide 636 and the second guide 656 without being brought into abutment with the front end 622 or the front end 642. In other words, when the connector 10 and the mating connector 80 are mated with each other, the side portion 818 is inserted between the front end 622 and the front end 642.

Figure 10:
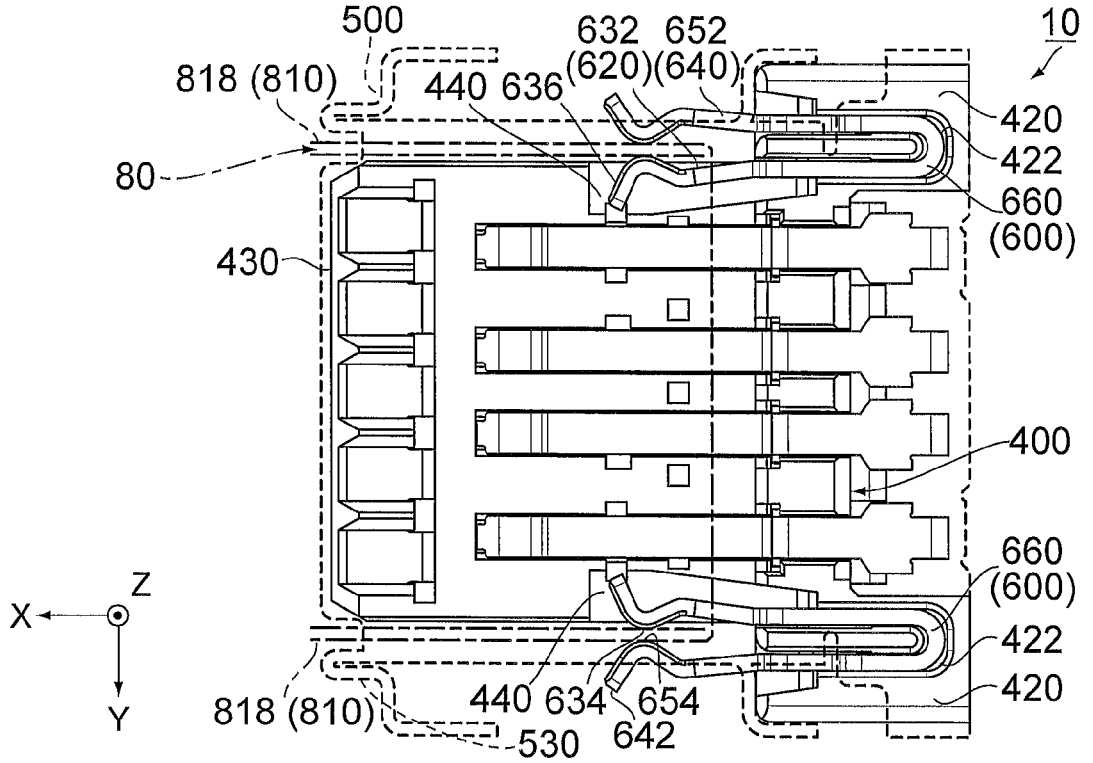
FIG. 10 is a top view showing the connector of FIG. 3, wherein the outline of the shell of the connector is illustrated by dashed line, and the outline of the mating shell of the mating connector under a mated state is illustrated by chain dotted line.

As can be seen from FIGS. 9 and 10, as the side portion 818 is further inserted along the negative X-direction, the first guide 636 is moved inward in the Y-direction while the second guide 656 is moved outward in the Y-direction. When the side portion 818 is further inserted along the negative X-direction, the mating connector 80 is completely mated with the connector 10 so that the connector 10 is in the mated state (the state shown in FIG. 10). Under the mated state, a part of the first portion 620, more specifically, a part of the first arm 632 and a part of the first guide 636, is moved inward in the Y-direction from the outside of the recess 440 to be located within the recess 440. Moreover, under the mated state, the front end 642 of the second portion 640 completely passes through the opening 532 of the shell 500 to be located in the receive portion 720 of the circuit board 700 (see FIG. 11).

Each of the first maintaining portion 634 and the second maintaining portion 654 is provided at a position in the X-direction where the side portion 818 of the mating connector 80 is reachable. Accordingly, when the connector 10 is in the mated state with the mating connector 80, the maintaining member 600 holds the side portion 818 of the mating shell 810 by the first maintaining portion 634 and the second maintaining portion 654 to maintain the mated state. In particular, according to the present embodiment, each of the first maintaining portion 634 and the second maintaining portion 654 is provided at a position where the side portion 818 of the standard USB-plug is reachable under the mated state. The maintaining member 600 according to the present embodiment can therefore maintain the mated state of the connector 10 with the standard USB-plug.

More specifically, the first maintaining portion 634 and the second maintaining portion 654 according to the present embodiment sandwich the side portion 818 in the Y-direction under the mated state. Accordingly, the mated state is maintained by a friction force between the side portion 818 and each of the first maintaining portion 634 and the second maintaining portion 654. In particular, according to the present embodiment, the first maintaining portion 634 and the second maintaining portion 654 are located at positions same as each other in the X-direction. Accordingly, the first maintaining portion 634 and the second maintaining portion 654 press the side portion 818 against each other to more securely maintain the mated state.

Moreover, according to the present embodiment, under the mated state, the two maintaining members 600 hold the two side portions 818, respectively, to maintain the mated state. In other words, the maintaining members 600, which are mirror-symmetrical to each other with respect to the XZ-plane, maintain the mated state at opposite sides of the connector 10. Accordingly, the mated state is stably maintained, for example, even when the mating connector 80 is forced to be moved in the Y-direction. Moreover, the insertion of the mating connector 80 can be detected by short-circuiting between the two maintaining members 600 with the mating shell 810 of the mating connector 80. In other words, the two maintaining members 600 can be used to form a detection mechanism.

As shown in FIG. 7, the coupling portion 660 of the maintaining member 600 couples the rear end 624 of the first portion 620, which extends forward, and the rear end 644 of the second portion 640, which extends forward, with each other. Accordingly, the first arm 632 of the first portion 620 and the second arm 652 of the second portion 640 can be made extend long. Moreover, as shown in FIG. 9, according to the present embodiment, the coupling portion 660 of the maintaining member 600 is arranged in the vicinity of the rear end 14 of the connector 10. Accordingly, the first arm 632 and the second arm 652 can be made extend sufficiently long. Moreover, the recess 440 (see FIG. 10) and the receive portion 720 (see FIG. 11) supply the space where the front end 622 and the front end 642 are largely movable.

As can be seen from the above explanation, according to the present embodiment, a movement amount of each of the first maintaining portion 634 and the second maintaining portion 654 in the Y-direction can be made sufficiently large. However, the maintaining member 600 may be formed differently from that of the present embodiment, provided that the first maintaining portion 634 and the second maintaining portion 654 can be moved sufficiently.

As shown in FIG. 9, under the unmated state, the first portion 620 and the second portion 640 according to the present embodiment intersect with each other when seen along the Z-direction. In detail, the second maintaining portion 654 is located inward in the Y-direction relative to the first maintaining portion 634, wherein the second maintaining portion 654 is to be moved outward in the Y-direction, and the first maintaining portion 634 is to be moved inward in the Y-direction. Accordingly, a relative movement amount between the first maintaining portion 634 and the second maintaining portion 654 can be made large. In addition, a holding force (friction force), with which the first maintaining portion 634 and the second maintaining portion 654 hold the side portion 818, can be made large. However, the first portion 620 and the second portion 640 do not need to intersect with each other, provided that a sufficient holding force can be obtained.

As shown in FIG. 9, according to the present embodiment, the maintaining member 600 is formed separable, or separately, from the shell 500. In other words, the shell 500 and the maintaining member 600 are members different from each other. Accordingly, the maintaining member 600 is formable independently from material of the shell 500 such as stainless and can have a thickness different from another thickness of the shell 500. More specifically, the maintaining member 600 is formable from material which enables the mated state to be properly maintained (for example, which cause a large holding force) to have a proper thickness. However, the maintaining member 600 may be formed integrally with the shell 500 in such a case where necessary effect can be obtained even when the maintaining member 600 is made of material same as that of the shell 500.

As shown in FIGS. 7 and 9, according to the present embodiment, the portions, or the components, of the maintaining member 600 are coupled with the coupling portion 660 to be formed integrally. Accordingly, the number of the components of the maintaining members 600 can be reduced. However, the coupling portion 660 does not need to be provided. For example, the first portion 620 and the second portion 640 may be formed separately from each other. In this case, each of the first portion 620 and the second portion 640 may be directly held by the holding member 400.

As described above, the mated-state maintaining structure according to the present embodiment is mainly formed of the first maintaining portion 634 and the second maintaining portion 654 which are movable in the Y-direction. Accordingly, the upper surface 510 and the lower surface 520 of the shell 500 are not required to be provided with a mated-state maintaining structure which is moved in the Z-direction (see FIGS. 3 and 4). In other words, each of the upper surface 510 and the lower surface 520 can be formed to be a uniform plane. Accordingly, the device (not shown) into which the connector 10 is installed can have a reduced size in the Z-direction.

Moreover, referring to FIG. 10, the side portion 530 of the shell 500 is folded back rearward at its front end. Even under the mated state, the front end 642 of the second portion 640 hardly projects outward in the Y-direction beyond this folded-backed portion. The mated-state maintaining structure according to the present embodiment therefore does not largely affect a size in the Y-direction of the device (not shown) into which the connector 10 is installed.

Moreover, referring to FIG. 11, under the attached state, the fixed portions 680 of the maintaining members 600 are inserted in the fixing portions 710 of the circuit board 700, respectively, to be fixed by soldering or the like. Under this state, if the fixed portions 680 are grounded to the circuit board 700, the mating shell 810 (see FIG. 2) is grounded via the maintaining members 600 in addition to the shell 500. As a result, shield effect can be improved.

The connector 10 according to the present embodiment can be variously modified in addition to the modifications which are already described.

Referring to FIG. 3, it is sufficient that at least one of the upper surface 510 and the lower surface 520 of the shell 500 is a plane that has no part projecting outward in the Z-direction and has no part projectable outward in the Z-direction. For example, the upper surface 510 of the shell 500 may be provided with a ground spring which is to be connected to the wide portion 812 of the mating shell 810 (see FIG. 1). This structure can strengthen shielding function of the connector 10. However, from a point of view of reducing the vertical size, or the size in the Z-direction, of the device (not shown) into which the connector 10 is installed, the connector 10 is preferred to be formed similar to the present embodiment.

Referring to FIGS. 2 and 8, the side portion 818 of the mating shell 810 may be provided with an opening. The mated state can be more securely maintained by this structure. In detail, the opening may be provided at a part, which corresponds to the first maintaining portion 634 and the second maintaining portion 654, of the side portion 818. By this structure, under the mated state, the first maintaining portion 634 and the second maintaining portion 654 pass through the opening of the side portion 818 to be brought into contact with each other and pressed against each other. In other words, the opening of the side portion 818 is locked by the first maintaining portion 634 and the second maintaining portion 654. Accordingly, the mated state can be further securely maintained. However, when a conductive path is required to be formed between the mating shell 810 and the circuit board 700 via the maintaining member 600, the mating shell 810 is preferred to be formed similar to the present embodiment.

Referring to FIG. 8, the first slope 630 and the second slope 650 of the maintaining member 600 are portions for adjusting the positions of the first maintaining portion 634 and the second maintaining portion 654 to the position of the mating shell 810 in the Z-direction. Accordingly, when such positioning is unnecessary, for example, when the connector 10 is not a drop-in connector, the first slope 630 and the second slope 650 do not need to be provided.

Figure 12:
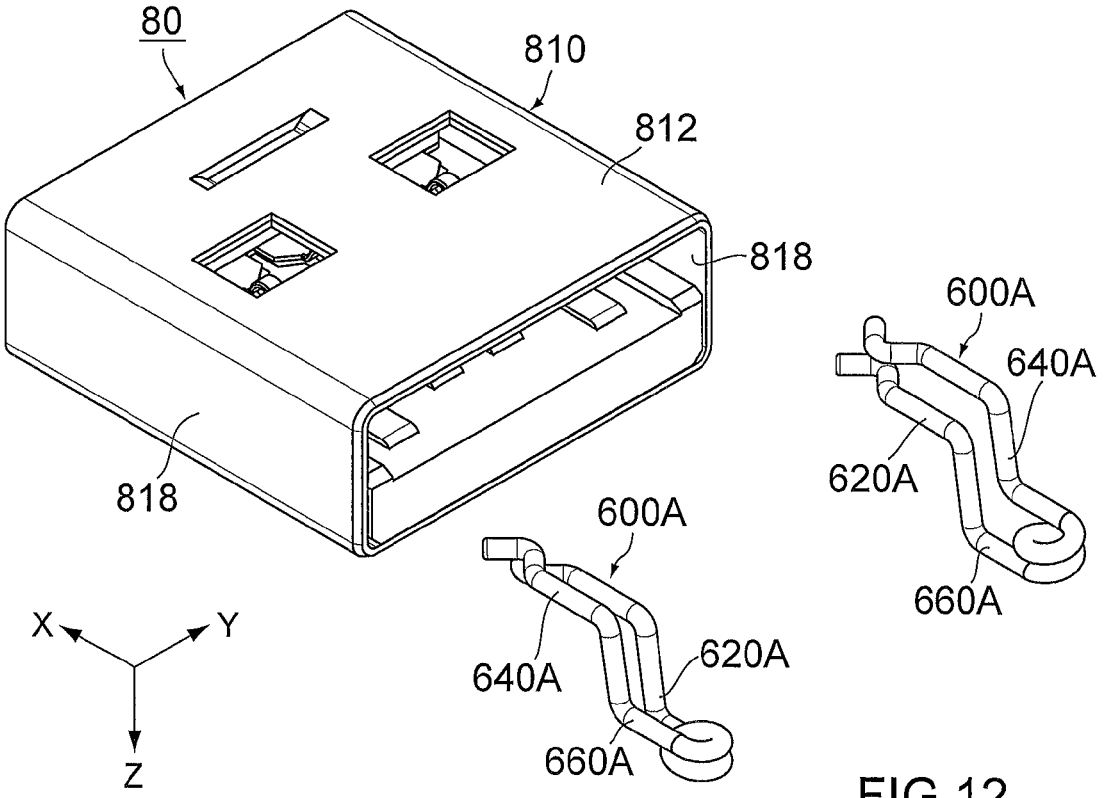
FIG. 12 is lower perspective view showing modifications of the maintaining members of FIG. 8 and a part of the mating connector.
Figure 13:
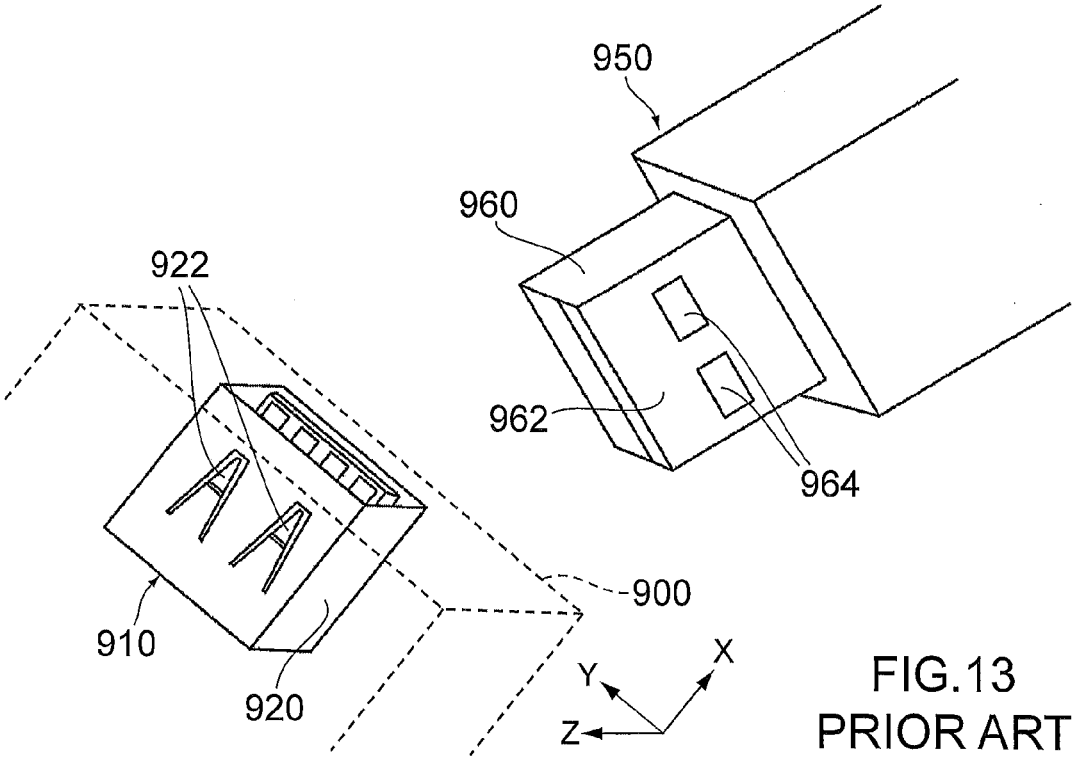
FIG.13 PRIOR ART
FIG. 13 is a perspective view showing an existing USB-socket and an existing USB-plug disclosed in Patent Document 1.

Referring to FIG. 12, for example, when the maintaining member 600 does not need to be connected to the circuit board 700 (see FIG. 11), the connector 10 may be provided with maintaining members 600A according to a modification instead of the maintaining members 600. Each of the maintaining members 600A is formed by bending a single wire rod. In detail, each of the maintaining members 600A has a first portion (inside portion) 620A, a second portion (outside portion) 640A and a coupling portion 660A which function similar to those of the maintaining member 600. However, each of the maintaining members 600A has no held portion and no fixed portion. The mated state can be also maintained by these maintaining members 600A.

The present application is based on a Japanese patent application of JP2014-025027 filed before the Japan Patent Office on Feb. 13, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector including a mating shell, wherein:

the connector has a mating end which is to be mated with the mating connector;

the mating end is located at a front end of the connector in a front-rear direction;

the connector comprises two or more contacts, a holding member, a shell and a maintaining member;

the holding member arranges the contacts in a pitch direction perpendicular to the front-rear direction to hold the contacts;

the shell has an upper surface and a lower surface in an upper-lower direction perpendicular to both the front-rear direction and the pitch direction;

one of the upper surface and the lower surface is a plane that has no part projecting outward in the upper-lower direction and has no part projectable outward in the upper-lower direction;

the maintaining member has a first portion and a second portion;

the first portion has a first arm and a first maintaining portion which is supported by the first arm;

the second portion has a second arm and a second maintaining portion which is supported by the second arm;

a front end of the first portion and a front end of the second portion are located apart from each other in the pitch direction;

when the connector and the mating connector are mated with each other, a side portion of the mating shell is inserted between the front end of the first portion and the front end of the second portion, wherein the side portion of the mating shell intersects with the pitch direction;

when the connector is in a mated state where the connector is mated with the mating connector, the maintaining member holds the side portion of the mating shell by the first maintaining portion and the second maintaining portion to maintain the mated state;

the holding member has a plate-like portion which extends along the front-rear direction and the pitch direction;

the plate-like portion is formed with a recess which is recessed inward in the pitch direction;

one of the first portion and the second portion is an inner portion;

a part of the inner portion is located at a position same as that of the recess in the upper-lower direction and located outward of the recess in the pitch direction; and under the mated state, the part of the inner portion is moved to inside of the recess.

2. The connector as recited in claim 1, wherein each of the upper surface and the lower surface of the shell is a plane that has no part projecting outward in the upper-lower direction and has no part projectable outward in the upper-lower direction.

3. The connector as recited in claim 1, wherein the first maintaining portion and the second maintaining portion are located at positions same as each other in the front-rear direction.

4. The connector as recited in claim 1, wherein:

the first portion has a first guide which is located forward of the first maintaining portion; and the second portion has a second guide which is located forward of the second maintaining portion.

5. The connector as recited in claim 1, wherein the side portion of the mating shell has no opening.

6. The connector as recited in claim 1, wherein:

the connector comprises two of the maintaining members;

the mating shell has two of the side portions; and under the mated state, the maintaining members hold the side portions, respectively, to maintain the mated state.

7. The connector as recited in claim 1, wherein:

the maintaining member is formed separable from the shell; and the maintaining member is held by the holding member.

8. The connector as recited in claim 1, wherein a front end of the inner portion is located within the recess.

9. The connector as recited in claim 1, wherein:

the connector is mateable with a standard USB-plug which is one type of the mating connector; and each of the first maintaining portion and the second maintaining portion is provided at a position in the front-rear direction where the side portion of the mating shell of the standard USB-plug is reachable.

10. The connector as recited in claim 1, wherein the maintaining member is formed by punching out and bending a single metal plate.

11. The connector as recited in claim 1, wherein the maintaining member is formed by bending a single wire rod.

12. The connector as recited in claim 1, wherein the maintaining member has a coupling portion coupling the first portion and the second portion with each other.

13. The connector as recited in claim 12, wherein the coupling portion couples a rear end of the first portion and a rear end of the second portion with each other.

14. A connector mateable with a mating connector including a mating shell, wherein:

the connector has a mating end which is to be mated with the mating connector;

the mating end is located at a front end of the connector in a front-rear direction;

the connector comprises two or more contacts, a holding member, a shell and a maintaining member;

the holding member arranges the contacts in a pitch direction perpendicular to the front-rear direction to hold the contacts;

the shell has an upper surface and a lower surface in an upper-lower direction perpendicular to both the front-rear direction and the pitch direction;

one of the upper surface and the lower surface is a plane that has no part projecting outward in the upper-lower direction and has no part projectable outward in the upper-lower direction;

the maintaining member has a first portion and a second portion;

the first portion has a first arm and a first maintaining portion which is supported by the first arm;

the second portion has a second arm and a second maintaining portion which is supported by the second arm;

a front end of the first portion and a front end of the second portion are located apart from each other in the pitch direction;

the first portion and the second portion intersect with each other when seen along the upper-lower direction;

when the connector and the mating connector are mated with each other, a side portion of the mating shell is inserted between the front end of the first portion and the front end of the second portion, wherein the side portion of the mating shell intersects with the pitch direction; and when the connector is in a mated state where the connector is mated with the mating connector, the maintaining member holds the side portion of the mating shell by the first maintaining portion and the second maintaining portion to maintain the mated state.

* * * * *